US007976321B2

(12) United States Patent
Schempp

(10) Patent No.: US 7,976,321 B2
(45) Date of Patent: Jul. 12, 2011

(54) ELECTRICAL CONNECTOR WITH A GROUND TERMINAL

(75) Inventor: Otto Schempp, Bad Rappenau (DE)

(73) Assignee: Molex Incorporated, Lisle, IL (US)

( * ) Notice: Subject to any disclaimer, the term of this patent is extended or adjusted under 35 U.S.C. 154(b) by 614 days.

(21) Appl. No.: 10/798,020

(22) Filed: Mar. 11, 2004

(65) Prior Publication Data

US 2004/0242036 A1 Dec. 2, 2004

(30) Foreign Application Priority Data

Mar. 11, 2003 (DE) ..... 103 10 502

(51) Int. Cl.
*H01R 13/648* (2006.01)

(52) U.S. Cl. ..... 439/108; 439/607.35

(58) Field of Classification Search ..... 439/108, 439/607, 608, 607.28, 607.32, 607.34, 607.35
See application file for complete search history.

(56) References Cited

U.S. PATENT DOCUMENTS

| | | | | |
|---|---|---|---|---|
| 6,139,366 | A * | 10/2000 | van Woensel | 439/609 |
| 6,171,149 | B1 * | 1/2001 | van Zanten | 439/608 |
| 6,322,379 | B1 * | 11/2001 | Ortega et al. | 439/108 |
| 6,347,962 | B1 | 2/2002 | Kline | 439/608 |
| 6,709,298 | B2 * | 3/2004 | Bradley | 439/701 |
| 6,780,069 | B2 * | 8/2004 | Scherer et al. | 439/752 |
| 6,790,088 | B2 * | 9/2004 | Ono et al. | 439/607 |
| 6,899,566 | B2 * | 5/2005 | Kline et al. | 439/608 |
| 2002/0111068 | A1 | 8/2002 | Cohen et al. | 439/608 |

* cited by examiner

*Primary Examiner* — Thanh-Tam T Le
(74) *Attorney, Agent, or Firm* — Stephen L. Sheldon

(57) ABSTRACT

The electrical connector has a dielectric housing, a plurality of signal terminals which are arranged in the housing, at least one ground terminal with a first contact section and a first spring arm section, the first contact section having a first contact and a second contact being mechanically coupled.

20 Claims, 8 Drawing Sheets

ELECTRICAL CONNECTOR WITH A GROUND TERMINAL

CROSS-REFERENCE TO RELATED APPLICATION

The present application claims priority of application serial number 103 10 502.6 filed on Mar. 11, 2003 in Germany.

FIELD OF THE INVENTION

The invention relates to an electrical connector with a ground terminal, to a connector assembly and to a method for assembling of the connector assembly in general, and to an electrical connector with a multiple contact ground terminal in particular.

BACKGROUND OF THE INVENTION

Connectors with a large number of signal terminals are typically used for the connection of complex circuit boards, in which case the connectors may have a modular structure in order to achieve a high degree of variability. Such connectors are used, for example, in service cabinets, in order to connect a large motherboard to a large number of parallel circuit boards.

Particularly in the case of electrical connectors such as these, there is an ever-present demand to increase the number of terminals in each connector, and to reduce the size of the connectors. These objectives are, however, partially contradictory for typical signal frequencies in the region of several GHz.

A modular connector with a metal bracket is known from the document US 2002/0111,068. However, this connector is subject to the risk of the metal bracket touching conductors of adjacent circuit boards when one circuit boards is being inserted between adjacent circuit boards, thus producing a short-circuit. Furthermore, the connector is not very robust and is difficult to assemble.

In the course of the desire to increase the maximum signal frequency, the connectors have typically been provided with a shield to prevent electromagnetic crosstalk. As the frequencies become ever higher, this shield is also subject to continuous pressure for improvement.

For example, a modular connector with a multi-contact ground shield is known from the document U.S. Pat. No. 6,347,962. However, two ground contacts are closed for each ground contact pair when connected to a mating male connector. In this connector, the first contact is used as a leading ground contact or provides an electrostatic discharge (ESD), that is to say it acts as so-called ESD protection. However, the double contact reduces the normal force in particular on the second contact, and this has a disadvantageous effect on contact reliability. A further disadvantage is that a high operating force is required due to the coefficient of friction. Furthermore, the connector has a fixed plug face, and is thus difficult to manufacture and is inflexible.

BRIEF SUMMARY OF THE INVENTION

Therefore, it is an object of the present invention to provide a variable connector which can be manufactured at low cost, and can be assembled easily.

A further object of the invention is to provide a connector, a connector assembly and a method for assembling those which avoid or at least ameliorate the disadvantages of the prior art.

A further object of the invention is to provide a connector which ensures a reliable and permanent connection, in particular for the ground terminals.

Still another object of the invention is to provide a connector which has a reliable ESD capability, while having good radio-frequency characteristics at the same time.

The object of the invention is achieved in a surprisingly simple manner by the subject matter of the independent claims. Advantageous developments of the invention are defined in the dependent claims.

According to the invention, an electrical connector is provided for a mating connection to a complementary mating connector in the longitudinal direction, wherein the connector comprises a dielectric housing, two or more signal terminals which are arranged in the housing, in particular each having a contact section and a rearward section for connection to a circuit board, and at least one ground terminal with a contact section and a spring arm section, with the contact section having at least a first and second contact or contact point, wherein the first and second contact are mechanically coupled, or mechanically interacting.

The movement coupling of the two contacts during connection and disconnection of the connector to the complementary mating connector, advantageously results in the capability to open and close the contacts or contact zones of the ground terminals in a coordinated manner.

In particular, the first and second contact form a first and second contact pair, respectively, with a complementary mating ground terminal of the complementary mating connector.

During connection to the complementary mating connector, the connector preferably first of all defines a completely unpaired state, in which the first and second contact pair are open. When the connector and the mating connector are joined together or plugged together further, the first or front contact pair closes first of all in an intermediate position, in order to provide a reliable electrostatic discharge (ESD). As they are then joined together further, the respective signal contacts of the connector and mating connector are connected to one another. Finally, the second contact pair is closed and the first contact pair is opened once again, representing the state of a completely mated final position of the connectors.

The first contact pair therefore provides a so-called "first-make-last-break" grounding. However, the second contact pair govern the good shielding that is also required for high frequencies in the final insertion position. The opening of the first contact pair in the completely mated final position results in an increased normal force on the second contact pair. Advantageously the minimum normal force that is required for a reliable contact is achieved with a reduced operating force at the same time. This advantage is particularly evident in the case of plugs with a large number of pins since, in this case, the operating forces are, of course, intrinsically relatively large, so that it is particularly desirable to reduce them. According to the invention, these advantages are additionally combined with a short signal path in the final position, so that the radio-frequency characteristics of the connector are also excellent.

In particular, the ground terminal comprises a shielding plate, from which the first and, if appropriate, further spring arm sections extend longitudinally or in the connecting direction. The shielding plate, preferably together with the arm section and the contact section, forms an integrally stamped shield against electromagnetic crosstalk between different connectors or connector modules.

The contact section is preferably located on a front free end of the respective arm section, and the first and second contact or the first and second contact zone are located in particular on the same resilient spring arm section, thus ensuring movement coupling between the two contacts.

The first and second contact are preferably arranged colinearly or transversely offset, with the former advantageously saving space and the second ensuring improved contact reliability due to the separate friction paths.

A contact or contact point is provided in a simple manner by the first ground terminal being stamped and formed and the first and/or second contact having a preferably domed or cupola-shaped stamped projection, in particular in the form of a part of a spherical surface. Alternatively or additionally, transversely stamped elongated beads have also been proven.

The contact section preferably also has at least a third contact, which is arranged in an equivalent manner to the second contact and/or is arranged longitudinally at the same point with respect to it. This embodiment is particularly advantageous for differential connectors with signal terminals which are arranged and connected in pairs, since each pair is associated to an arm section, and a first and second signal terminal of a pair is associated to a first and a second leg of the arm section and to the second and third contact, respectively, with the second and third contact preferably being arranged on the first and second leg, respectively.

Furthermore, a stamped recess is preferably located between the first and the second leg, and the two legs are connected at a head section, on which the first contact is arranged transversely between the second and third contact. This advantageously slightly decouples the movement of the second and third contact. The first, second and third contact preferably form a triangular arrangement.

Alternatively, the ground terminal has a spring arm section and a contact section, preferably with at least two colinearly arranged contact points or zones for each signal terminal. This embodiment is particularly suitable for coaxial connections.

According to a preferred embodiment of the invention, the spring arm section has a first and/or second resilient spring section, which connects the first or second leg, respectively, to the shielding plate. The spring sections are, in particular, inclined with respect to the shielding plate and/or the legs, thus forming a resilient step-like configuration.

It is particularly preferable for the signal terminals to be arranged in a first plane and for one surface of the ground terminal to face the first plane and to be resilient or sprung in a direction transverse with respect to the first plane. Furthermore, the head section is preferably curved away from the signal terminals in the spring direction, in order to ensure that a mating ground terminal is inserted between the ground terminal and the signal terminals without getting stuck.

According to a preferred exemplary embodiment of the invention in the form of a connector for differential signals, the signal terminals are arranged in pairs, and the distance between the signal terminals of a pair is less than or equal to the distance between signal terminals of adjacent pairs. In this case, the ground terminals for each signal terminal pair preferably has an, in particular identical spring arm section and contact section. It is particularly preferable for the space between the arm sections to be shielded against electromagnetic crosstalk by means of a shielding section which is stamped or formed integrally with the ground plate, the arm sections and/or the contact sections.

The connector according to the invention is particularly suitable for use as a connector module in a modular electrical connector or plug connector assembly.

According to a preferred embodiment of the invention, the connector assembly has a front face or a plug face with two or more openings or guide openings for receiving complementary mating terminals, for example pin terminals in a mating connector. In this case, the size of the openings is adapted to the diameter of the mating pin terminals. Furthermore, a plurality of connector modules each having a dielectric module housing and each having a plurality of terminals for establishing electrical connections to the complementary mating terminals form a module stack with layers transversely with respect to the connection direction. The module housings or so-called "chicklets" have channels for receiving the terminals. Furthermore, the module housings each have an front face or surface or a plug face, and each has at least a side surface for engaging the adjacent module housing. In addition, a dielectric main housing is also provided, to which the modules are attached in an assembled state.

The front faces of the module housings together and/or directly form the front face or the flat and/or exposed plug face of the connector, since the housing has an opening or recess through which the front faces of the module housings are accessible, at least partially. In particular, the opening or recess in the main housing is of such a size that two or more openings, preferably all of them, in the module housings, are accessible through them. Thus, in particular, the main housing does not have a front face with individual guide openings for pin terminals of the mating connector.

Connector assemblies with different numbers of modules can thus be assembled in an advantageous manner with little cost involved. All that is required is an appropriately matched main housing, which can be manufactured very simply and at low cost by means of injection molding. In particular, there is no need to have a separate tool for each module structure for manufacturing a front face with a complex arrangement of guide receptacles.

The main housing is preferably essentially L-shaped, in particular covering an upper face and a rear face of the stack, or the main housing engages or encompasses the upper and rear faces of the stack and is open on at least one side, in particular at the end. Furthermore, the main housing preferably comprises a dielectric baseplate, i.e. comprises at least two parts. The baseplate is preferably attached to the stack by means of a longitudinal dovetail guide.

In order to guide it with respect to the mating connector, the connector assembly has a first guide means, in particular in the form of a front-chamfered peg in order to interact in pairs with a complementary mating guide means, for example a rectangular longitudinal groove, on the mating connector. The first guide means is preferably arranged on an upper face of the connector assembly, in particular being attached to the main housing or being formed integrally with it, in particular being integrally molded.

Furthermore, a second guide means (which, in particular, is designed in the same way as the first) is preferably arranged on a lower face of the connector assembly, opposite the upper face.

According to a further preferred embodiment of the invention, the module housings each have a receptacle for detachably mounting on the second guide means, and the second guide means can be attached to the connector assembly at various positions. In particular, two or more separate guide elements are provided, which can be used variably and can thus form a coding and/or a variable polarity-reversal protection.

The guide elements are preferably detachably connected to the module housings form-fit, with the guide elements being arranged in particular between two adjacent modules.

Alternatively or additionally, the second guide means or its guide elements is or are arranged on the baseplate, in particular being formed integrally with it. Although this embodiment is not as variable as separate guide elements, but it has the advantage that it is more robust.

Preferably, the module housings can be plugged into corresponding openings in the main housing and can be attached with a friction lock by means of at least one and preferably two or more pegs in each case. In particular, the openings form press fits for the pegs.

According to a preferred embodiment of the invention, the method is also provided for assembling of a modular electrical plug connector assembly. At least one, and preferably two or more or all of the following steps is or are carried out, in particular in the following sequence:

- manufacturing of two or more connector modules, wherein
  - a module housing is provided in each case,
  - a shield is attached to each of the module housings,
  - two or more terminals are inserted into each of the module housings, and
  - the terminals are fixed in each of the module housings,
- assembling of the connector modules to form a stack,
- providing of a main housing and,
- inserting of the connector modules into the main housing, wherein either
  - the connector modules are joined together or packaged to form a stack before insertion into the main housing, and the stack is inserted as an entity into the main housing, or
  - the connector modules are inserted into the main housing successively, in particular individually, and are joined together in the process at the same time.

In order to mount the terminals in the module housing, the terminals are preferably inserted or pressed into channels in the module housing, and/or a cover, possibly with a positive shape of the channels, is then fitted to or pressed onto the module housing. However, the terminals may also be hot-stamped in the module housing.

The guide element or elements is or are inserted and/or fixed to the connector modules during the packetization of the module housings.

The invention will be explained in more detail in the following by means of exemplary embodiments and with reference to the attached drawings, wherein identical and similar elements are provided with the same reference signs, and in which case the features of the various exemplary embodiments may be combined with one another.

DETAILED DESCRIPTION OF THE INVENTION

FIGS. 1 to 8 show components of a coaxial version of a modular connector assembly according to a first embodiment of the invention.

Figure 1:
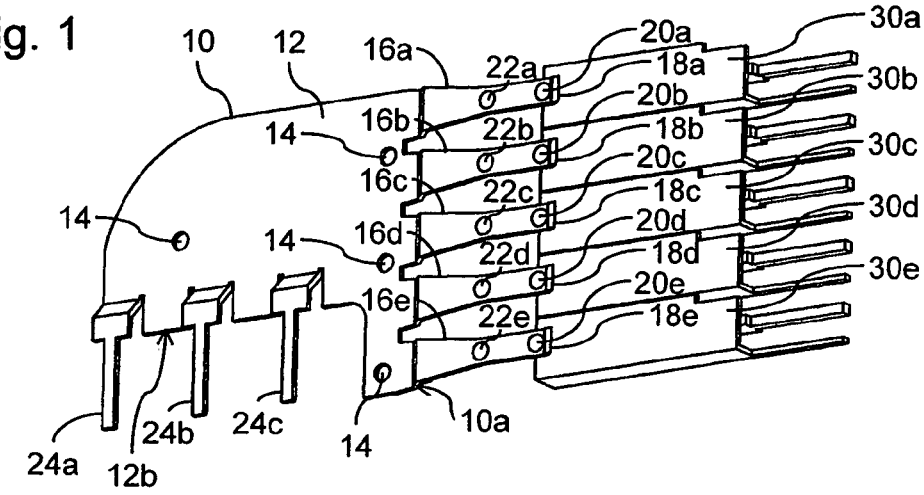
FIG. 1 shows a perspective view of a ground terminal for a modular connector according to a first embodiment of the invention, with a mating ground terminal in a first intermediate position.

FIG. 1 shows a ground terminal 10, stamped and formed from metal, with a shielding plate 12 which has four attachment openings 14 for receiving complementary pegs. Furthermore, on a front edge 10*a*, the ground terminal 10 has five spring arm sections 16*a*-16*e*, which each have a contact section 18*a*-18*e* which is at a distance from the shielding plate 12.

Each contact section 18*a*-18*e* has in each case one round, embossed, front contact point 20*a*-20*e* and in each case one round, embossed, rear contact point 22*a*-22*e*.

Furthermore, three solder pins 24*a-c* are arranged on a lower face 12*b* of the shielding plate 12 in order to be contacted with a circuit board.

Furthermore, complementary mating ground terminals 30*a*-30*e*, with an L-shaped cross section, are shown, with one mating ground terminal in each case being associated with a respective arm section of the ground terminal 10.

Figure 4:
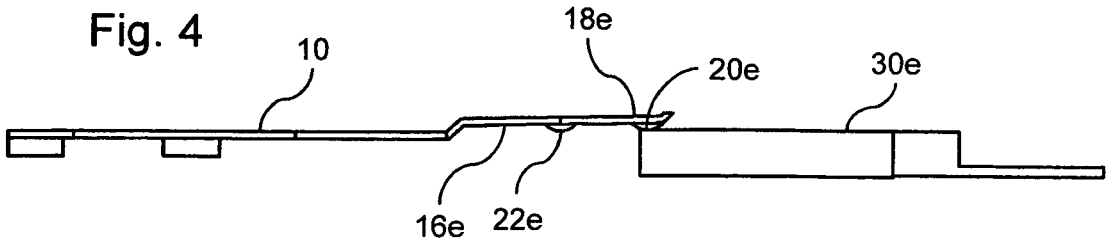
FIG. 4 shows a side view of the ground terminal as shown in FIG. 1 in the first intermediate position.

FIGS. 1 and 4 show the configuration comprising the ground terminal 10 and mating ground terminals 30*a*-30*e* in an intermediate position, in which the front contact points 20*a*-20*e* each make contact with the complementary mating ground terminals 30*a*-30*e*.

Figure 2:
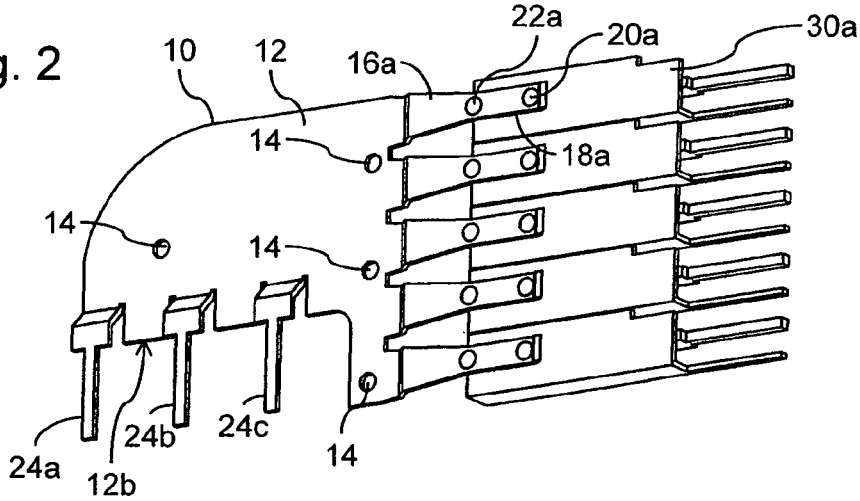
FIG. 2 shows a perspective view of the ground terminals shown in FIG. 1 in a second intermediate position.
Figure 5:
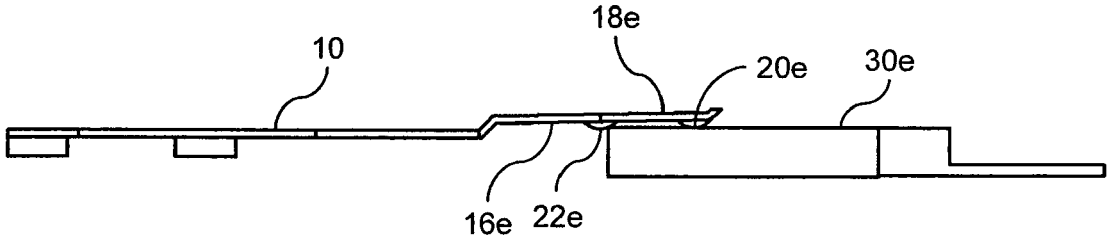
FIG. 5 shows a side view of the ground terminal as shown in FIG. 2 in the second intermediate position.

FIGS. 2 and 5 show a second intermediate position in which, in addition to the front contact point 20*a*-20*e*, the rear contact points 22*a*-22*e* likewise each make contact with the mating ground terminals 30*a*-30*e*.

The front contact points 20*a*-20*e* and the rear contact points 22*a*-22*e* are now respectively mechanically coupled to one another such that, when the ground terminal 10 and the mating ground terminals 30*a*-30*e* are pushed further together, the arm sections 16*a*-16*e* are bent away from the complementary mating ground terminals by means of a force which is exerted by the mating ground terminals 30*a*-30*e* on the rear contact points 22*a*-22*e*. This results in the front contact points 20*a*-20*e* being raised at least to such an extent that they once again lose their contact with the complementary mating ground terminals, and the corresponding contact pairs are opened.

Figure 3:
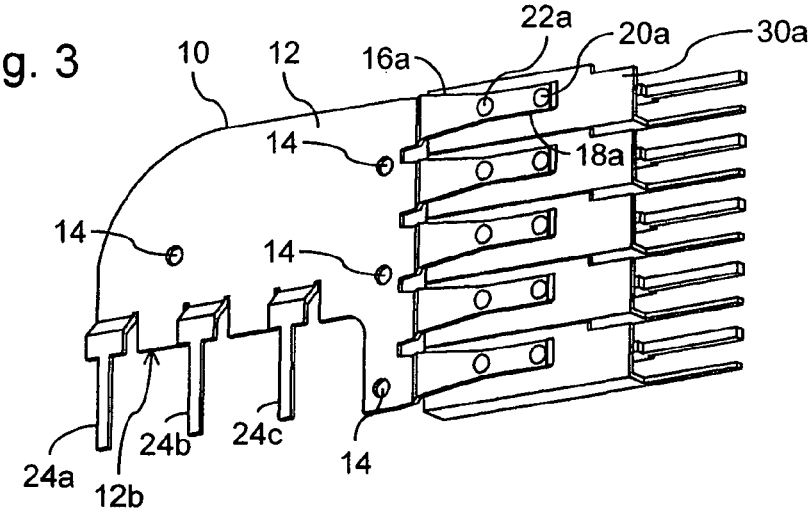
FIG. 3 shows a perspective view of the ground terminal as shown in FIG. 1 in a completely mated final position.
Figure 6:
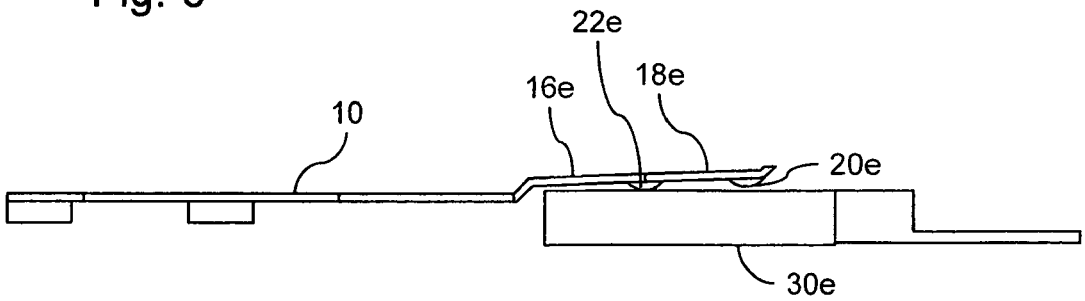
FIG. 6 shows a side view of the ground terminal as shown in FIG. 3 in the mated final position.

This state, which is reached at the latest in a mated final position, is illustrated in FIGS. 3 and 6. In the mated final position, the arm sections 116*a*-116*e* are spring biased against the mating ground terminals 30*a*-30*e*, and each of the front contact pairs 20*a*-20*e*, 30*a*-30*e* are opened.

Figure 7:
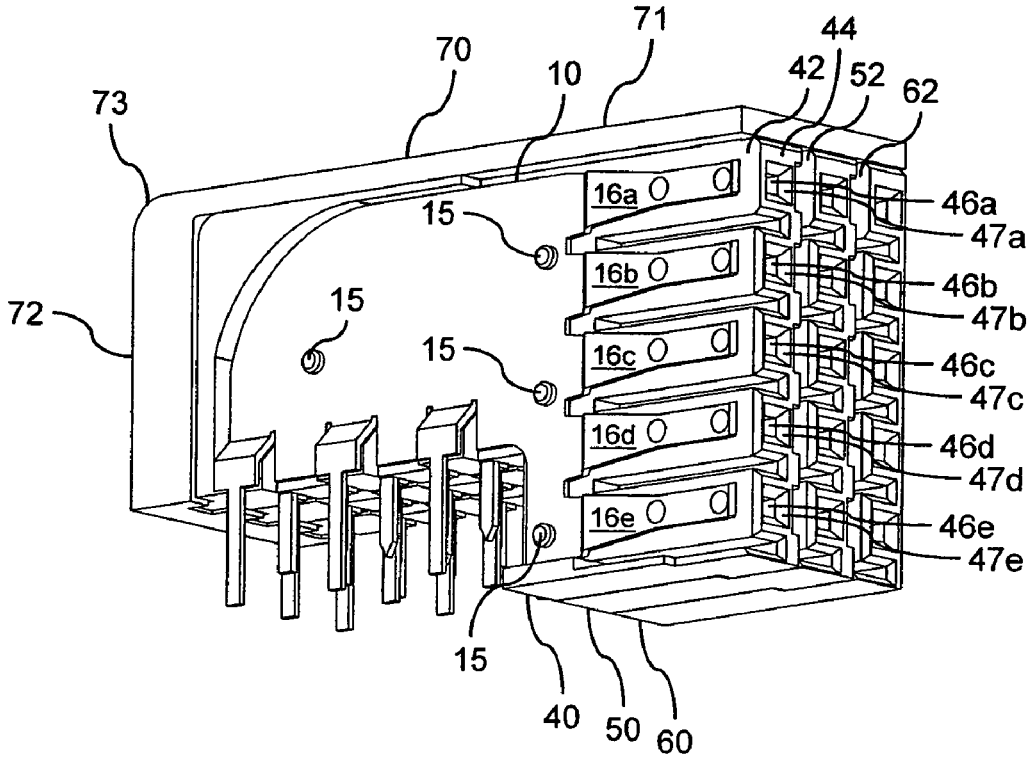
FIG. 7 shows the first embodiment of the connector with the ground terminal as shown in FIG. 1 in a perspective view from the right-hand side.

FIG. 7 shows a stack of three connector modules 40, 50, 60, having a respective module housing 42, 52, 62 and a ground terminal. In this case, the connector modules are each identical, for which reason the following text will refer for the sake of simplicity only to the first connector module 40.

Figure 8:
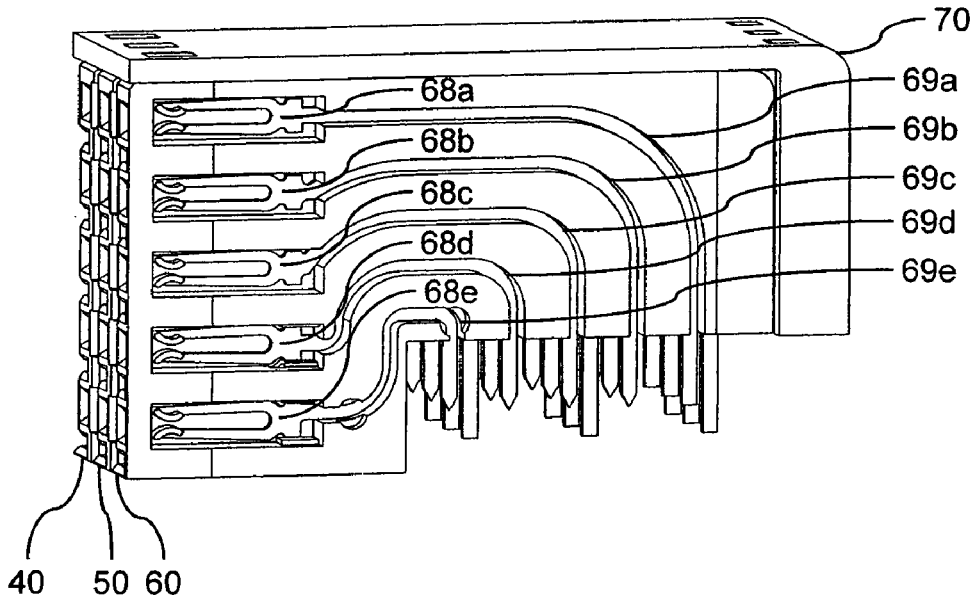
FIG. 8 shows the connector as shown in FIG. 7 in a perspective view from the left-hand side.

The connector module 40 has a front end face 44 with five square openings 46*a*-46*e*, behind each of which contact can be made with a signal terminal 48*a*-48*e* (not shown in FIG. 7). Corresponding signal terminals 68*a*-68*e* are shown in FIG. 8.

Once again with reference to FIG. 7, the end-face openings 46*a*-46*e* are each designed to receive a contact pin of a complementary mating connector, and each have a funnel-shaped, in particular square, mouth 47*a*-47*e*.

The ground terminal 10 is mounted by means of four pegs 15, which are formed integrally with the module housing 42.

Furthermore, the connector modules 40, 50, 60 are held in an L-shaped dielectric main housing 70. The main housing 70 therefore has at least one first top wall 71, which is arranged on one face, in particular the upper face, of the module stack and extends from the front face of the stack to the rear face which is opposite the front face. Furthermore, the main housing has a rear wall 72, one edge 73 of which is connected, preferably integrally, to the first wall 71.

Referring to FIG. 8, the signal terminals 68*a*-68*e* are arranged or held in a respective receptacle channel 69*a*-69*e*. The signal terminals 68*a*-68*e* are arranged at equidistant intervals.

Furthermore, each signal terminal 68*a*-68*e* has one, and only one, associated arm section. The arm sections effectively shield the signal terminals from the signal terminals of the adjacent connector module.

FIGS. 9 to 13 show elements and views of a second embodiment of a modular connector assembly according to the invention, with signal terminals arranged in pairs for differential signals.

Figure 9:
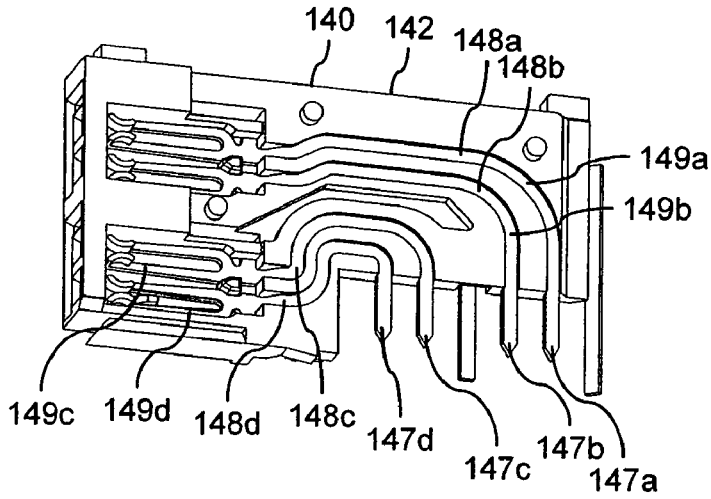
FIG. 9 shows a perspective view from the left of a second embodiment of a connector module according to the invention.

FIG. 9 shows a connector module 140 with a module housing 142 in which two pairs of signal terminals 148*a*-148*e* are arranged. The signal terminals are pressed into channels 149*a*-149*d*, and have respective solder pins 147*a*-147*d*.

Figure 10:
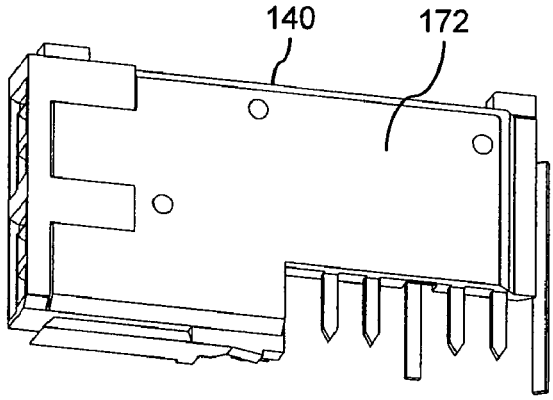
FIG. 10 shows a perspective view of the connector module as shown in FIG. 9, with a ground terminal and a fitted cover.

FIG. 10 shows the connector module 140 with a cover 172 pressed on.

Figure 11:
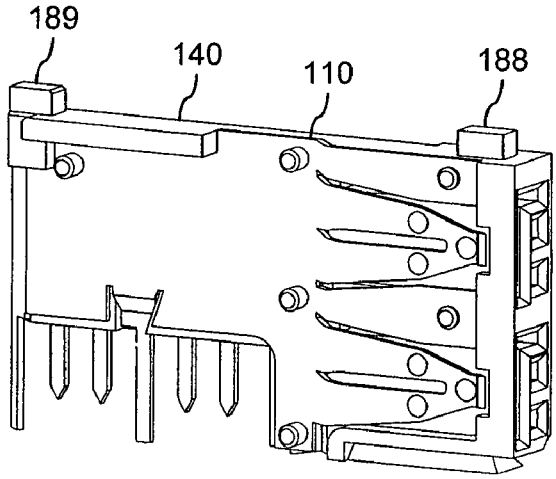
FIG. 11 shows a perspective view from the right of the connector module shown in FIG. 10.

FIG. 11 shows the connector module 140 from the side opposite the cover 172, onto which side a ground terminal 110 is pressed.

Figure 12:
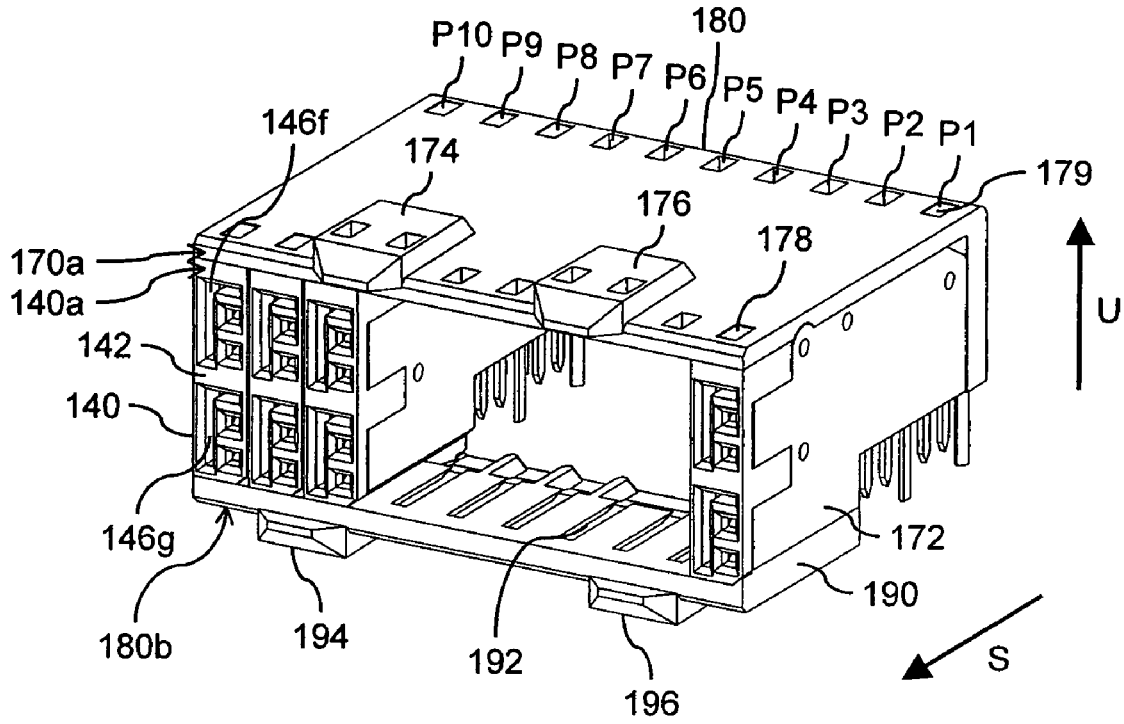
FIG. 12 shows a perspective view from the front, from the left and from above of the second embodiment of a connector assembly according to the invention.

FIG. 12 shows a modular connector assembly 180 with ten slots, each for one connector module 140, only four of which are shown, for the sake of clarity. In addition to the four connector modules 140 (or ten connector modules 140 when it is fully fitted), the connector assembly 180 has an essentially L-shaped main housing 170. The main housing 170 has two guide elements 174, 176 on a front face or end face 170*a*, which project beyond the front face 170*a* and are chamfered on four sides. Furthermore, the guide elements 174, 176 are essentially cuboid and are integrally connected, in particular by plastic injection molding, to the main housing 170, which is composed of dielectric material.

The dielectric housing 170 has a front and rear press fit 178, 179 for each connector module, in which the module housings are mounted with a friction lock by means of rectangular peg 188, 189. In consequence, the connector modules can be pushed into the main housing 170 from underneath in the direction annotated by U, with the direction U running transversely with respect to or at right angles to the connection or insertion direction S.

On a lower face 180*b* of the connector assembly, a dielectric plastic baseplate 190 is mounted on the connector modules by means of a respective longitudinal dovetail guide 192. The baseplate 190 can accordingly be pushed onto the module stack from the front, that is to say in the opposite direction to the insertion direction S. Alternatively, a transverse dovetail guide may also be provided.

On its lower face, the baseplate 190 has two guide elements 194, 196, which are essentially formed like the guide elements 174, 176.

However, the guide elements 174, 176 for the main housing 170 are arranged at the positions P3 and P4, as well as P7 and P8, respectively, with respect to the module slots for the connector modules, with the two lower guide elements 194, 196 being offset outwards by one connector module, that is to say being arranged at the positions P2 and P3, as well as P8 and P9 respectively. This ensures reliable polarity-reversal protection, in conjunction with corresponding guide rails on a mating connector.

On its front face 140*a*, the module housing 142 furthermore has L-shaped insertion openings 146*f*, 146*g*, which are each associated with a pair of signal terminals, for the mating ground terminals.

The main housing 170 together with the baseplate 190 forms a two-piece dielectric housing which is completely open on the front face 170*a* in order to expose the front faces of the module housings. In consequence, the front face of the connector is essentially defined by the front faces of the module housings, which are arranged flush with the front faces of the main housing. This has the major advantage that virtually any desired number of connector modules can be stacked for different stack sizes, and only the simple components of the main housing 170 and baseplate 190 are manufactured and stocked in different widths.

Figure 13:
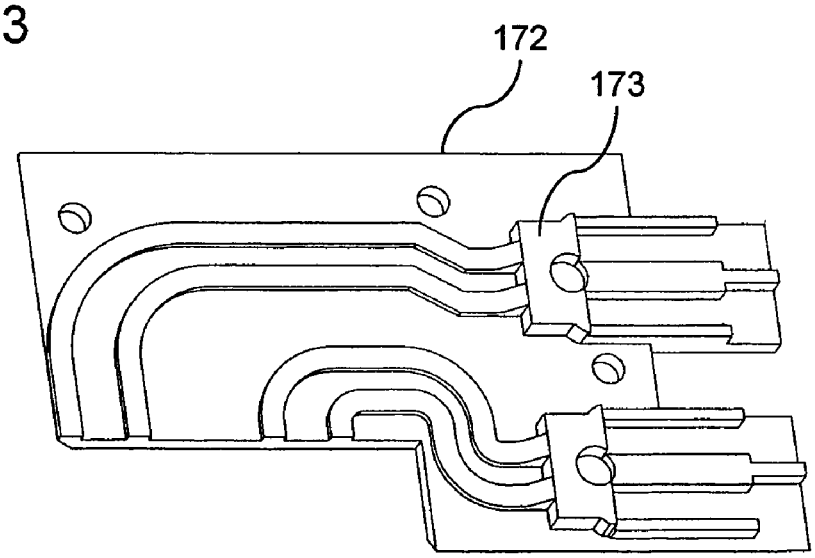
FIG. 13 shows a view of the inside of the cover shown in FIG. 10.

FIG. 13 shows an internal view of the cover 172 with a positively projecting structure 173, which is matched to the guide channels 149*a*-149*d* in order to reliably enclose the signal terminals 148*a*-148*d* on all sides.

Figure 14:
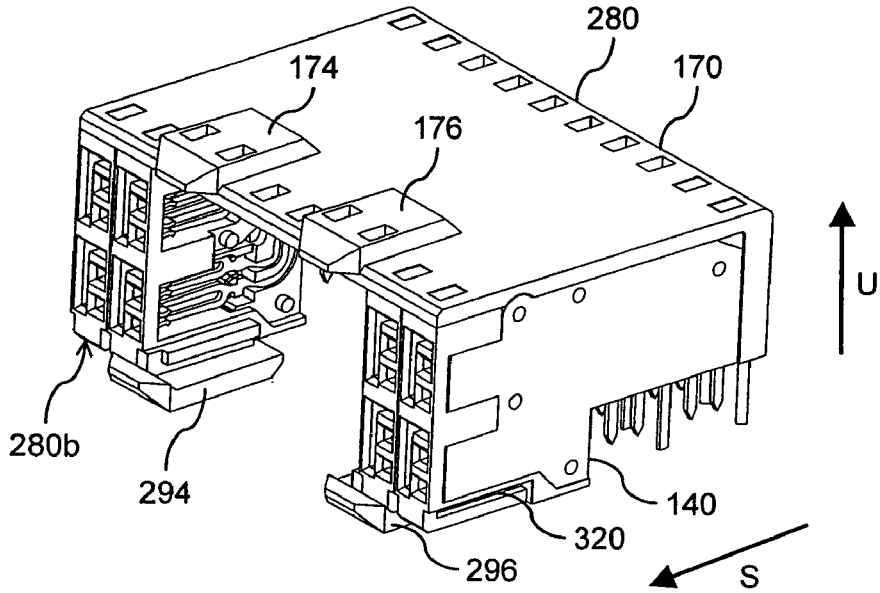
FIG. 14 shows a perspective view from the front, from the left and from above of a third embodiment of a connector assembly according to the invention.
Figure 15:
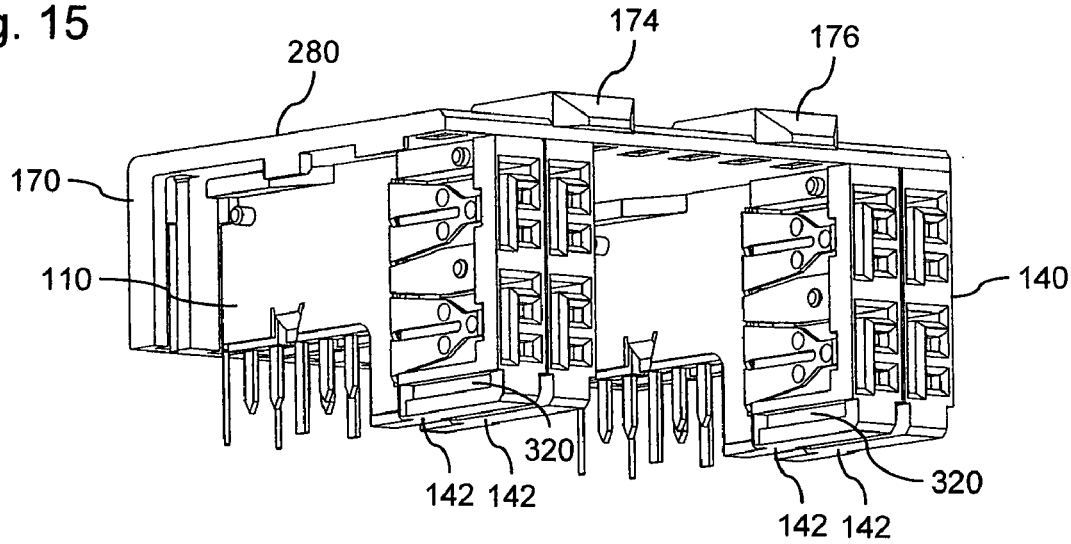
FIG. 15 shows a perspective view from the front, from the right and from underneath of the connector assembly shown in FIG. 14.
Figure 16:
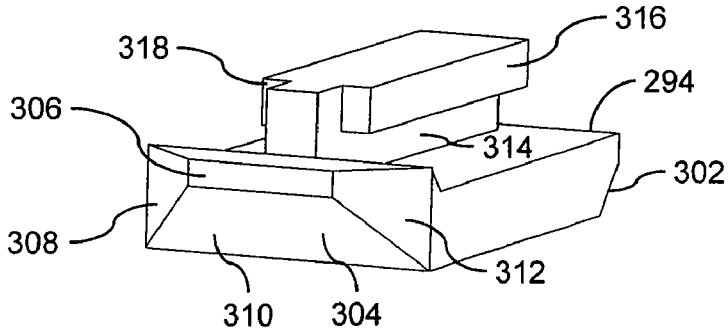
FIG. 16 shows a perspective view of a guide element.

FIGS. 14 to 16 show a further embodiment of the modulator connector assembly according to the invention which, in principle, is similar to the embodiment illustrated in FIGS. 9 to 13. However, instead of an integral, fixed baseplate, the further embodiment has two or more separate guide elements, which can be used in a variable manner.

FIG. 14 shows a modular connector assembly 280 which is partially fitted with four connector modules 140. The L-shaped main housing 170 corresponds to the connector assembly 180.

Two separate guide elements 294, 296 are hooked in on the lower face 280*b* in an interlocking manner. FIG. 15 shows the connector assembly 280 in an illustration rotated with respect to FIG. 14 and without the lower guide elements 294, 296.

FIG. 16 shows the guide element 294 in detail. The guide element 294 has a lower guide block 302 with an inclined insertion section 304 on its front face. The insertion section 304 has an end surface 306 and three inclined side surfaces 308, 310, 312.

Furthermore, the guide element 294 has a holding web 314 which extends upwards and has two mutually opposite latching projections 316, 318.

The latching projections 316, 318 mount the guide element 294 form-fit in each case one groove 320, which grooves 320, as is illustrated in FIG. 15, are provided in the module housings 142.

In this case, each module housing 142 has a groove 320 on each of two faces, so that the guide element 294 can be inserted between two adjacent module housings at each position. Thus, in addition to the polarity-reversal protection function, this provides variable coding, so that different connectors cannot be confused.

Figure 17:
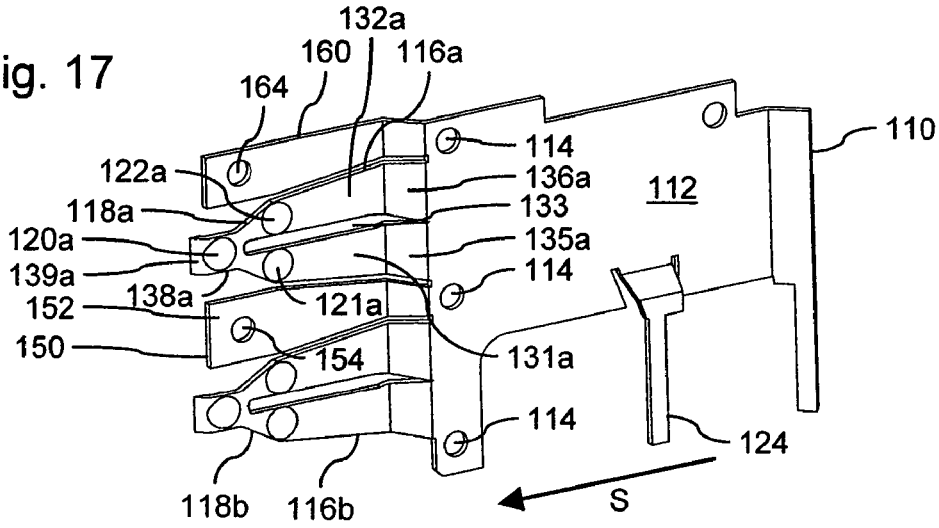
FIG. 17 shows a perspective detailed illustration of the ground terminal according to the invention as shown in FIG. 15.
Figure 18:
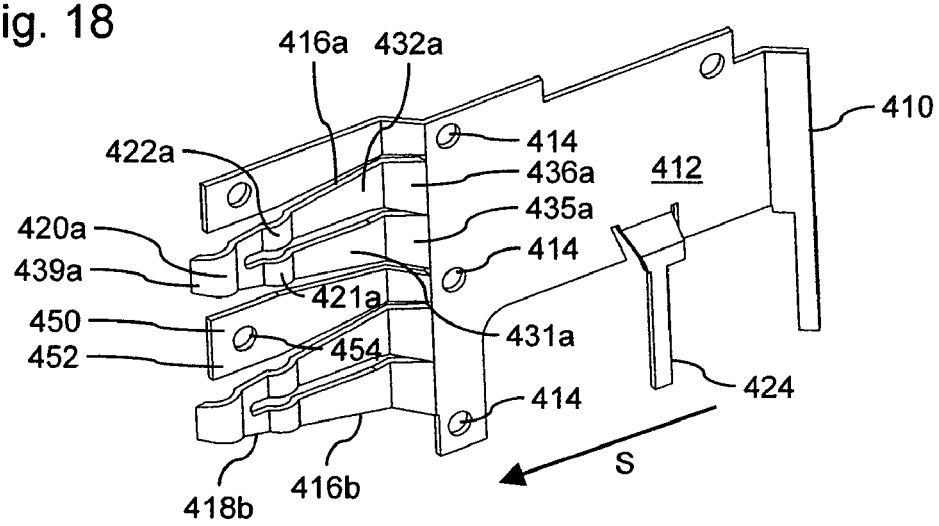
FIG. 18 shows a perspective illustration of a fourth embodiment of a ground terminal according to the invention.

FIG. 17 shows the ground terminal 110 of the connector modules 140 in detail.

The ground terminal 110 has a shielding plate 112 with mounting openings 114 and a first solder pin 124.

Two spring arm sections 116*a*, 116*b* extend in the longitudinal direction S on a front face of the ground terminal 110. A respective contact section 118*a*, 118*b* is arranged at that end of the arm sections 116*a*, 116*b* which is distal from the shielding plate 112. For the sake of simplicity, the following text describes only the first arm section 116*a*, with the second arm section 116*b* being identical.

The contact section 118*a* has a front contact point 120*a* and two contact points 121*a* and 122*a*, which are offset transversely with respect to one another and with respect to the front contact point 120*a*. The two rear contact points 121*a*, 122*a* are located on a respective spring leg 131*a*, 132*a*. The adjacent legs 131*a*, 132*a* are separated from one another by a recess 133, which tapers towards the rear.

The triangular arrangement of the contact points 120*a*, 121*a*, 122*a* results in a transverse offset between the corresponding friction paths on the associated mating terminal, thus keeping the mechanical wear as low as possible.

The legs 131*a*, 132*a* are connected resiliently to the shielding plate 112 by means of a respective angled spring section 135*a*, 136*a*. The two legs 131*a*, 132*a* run together to form a head section 138*a* at the front end of the arm section 116*a*, and the front contact point 120*a* is arranged on this head section 138*a*. The head section 138*a* has a curved guide section 139*a*.

The arm section 116*a* as well as the two legs 131*a*, 132*a* are essentially trapezoidal in shape, that is to say they are designed such that they taper in the forward direction.

The arm section 116*a* is attached resiliently to the spring section 135*a*, 136*a*, transversely with respect to the connection direction S.

The arrangement of the three contact points 120*a*, 121*a*, 122*a* on the same arm section results in the contact points being mechanically coupled or correlated. This results in interaction between the movement of the contact points. The trapezoidal shape of the arm section 116*a* results in an improved distribution of the spring force between the three contact points.

An intermediate section 150, which further improves the shielding, is arranged between the two arm sections 116*a*, 116*b*. On its front section 152, the intermediate section 150 has an opening 154, by means of which the intermediate section is attached to the respective module housing 140 or to a peg 156.

FIG. 16 shows a third embodiment of a ground terminal 410.

Instead of the contact points 120*a*, 121*a*, 122*a*, which are similar to spherical surfaces, the third ground terminal 410 in each case has a cylindrical or bead-like contact or contact zones 420*a*, 421*a*, 422*a*, which runs or run transversely with respect to the insertion direction S. Apart from this, the ground terminal 410 is designed in the same way as the ground terminal 110.

Figure 19:
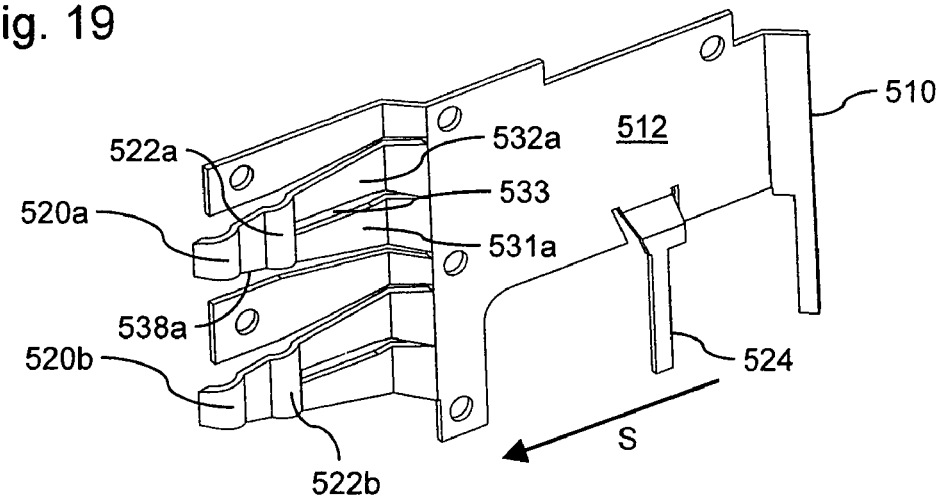
FIG. 19 shows a perspective illustration of a fifth embodiment of a ground terminal according to the invention.

A fourth embodiment of a ground terminal 510 according to the invention is illustrated in FIG. 19. In the ground terminal 510, the two rear contacts are not arranged on the legs 531*a* and 532*a*, but a contact zone 522*a* extends transversely with respect to the insertion direction S on the head section 538*a*.

Figure 20:
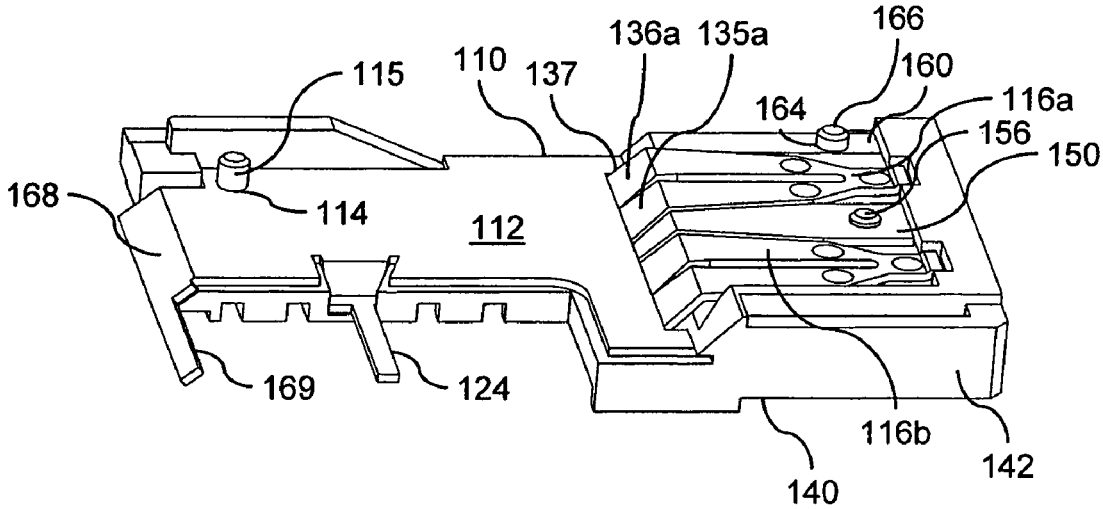
FIG. 20 shows a perspective illustration of the ground terminal shown in FIG. 17, mounted on a module housing.

FIG. 20 shows a perspective side view of the ground terminal 110 mounted on the module housing 140. In this case, a peg 115 extends through the opening 114 in the shielding plate 112 and is then hot-stamped in order to mount the ground terminal 110 on the module housing 142. Other openings 114 which are illustrated in FIG. 17 have been omitted for the sake of clarity.

The intermediate section 150 is mounted in an equivalent manner by means of the peg 156 which extends through the opening 154. This makes the arrangement very robust. Moreover, a further shielding section 160 is attached to the module housing 142, adjacent to the first arm section 116*a*, by means of a peg 166 and an opening 164.

In addition, the ground terminal 110 has a ramp section 137 which is angled with respect to the shielding plate 112 and the arm sections 116*a*, 116*b* and, inter alia, has spring sections 135*a*, 136*a*.

At its rearward end, the ground terminal 110 also has an angled holding section 168 with a second solder pin 169. The angled holding section can be inserted into a corresponding groove in the main housing 170.

Furthermore, the first solder pin 124 is offset laterally with respect to the shielding plate 112, in order to allow to connect it colinearly to a printed circuit board, which is not illustrated, by means of the second solder pin 169.

Furthermore, the first and second solder pins 124, 169 are arranged colinearly with solder pins 147*a*-147*d*, as can best be seen in FIG. 10. Furthermore, the first solder pin 124 of the ground terminal 110 is located between adjacent pairs of signal terminals, or their pin sections 147*a*-147*d*.

Figure 21:
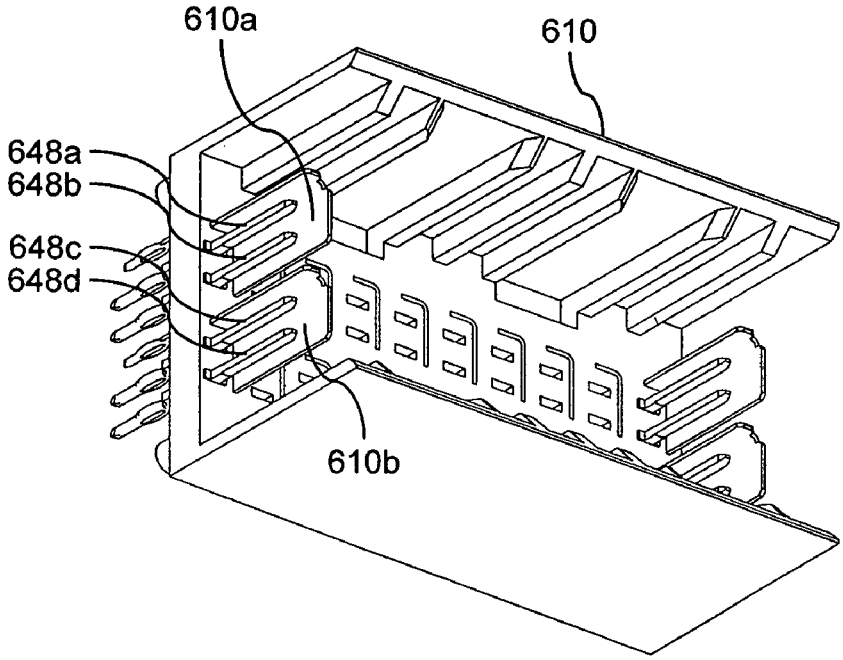
FIG. 21 shows a perspective illustration of a mating connector for connection to the connector assembly shown in FIG. 12.

FIG. 21 shows a male connector or mating connector with a plurality of mating signal pin terminals 648*a*-648*d*, which are arranged in pairs, for each connector module. Furthermore, the mating signal pin terminals are shielded from adjacent mating signal pin terminal pairs by means of L-shaped mating ground terminals 610*a*, 610*b*, which are each associated with one pair of signal pin terminals. When the connector assembly 180 and the mating connector 610 are mated, the ground terminal 110 is electrically connected to the two mating ground terminal 610*a*, 610*b* for each connector module.

As is obvious to those skilled in the art, the embodiments described above should be regarded merely exemplary and the invention is not restricted to them, but may be varied in many ways without departing from the scope and spirit of the invention.

The invention claimed is:

1. A modular electrical connector system, comprising:

a first connector with plurality of signal terminals and a plurality of ground terminals arranged in columns and rows; and a second connector configured to engage the first connector, the second connector configured to translated from an unmated position to a mated position, the mated position having the first and second connector coupled together, the second connector comprising:

a main housing;

a plurality of connector modules supported by the main housing, each connector module having a dielectric module housing, wherein the module housings each having a front face, and the front faces of the module housings together forming a front face of the second connector, the front face with a plurality of openings configured to receive the plurality of signal and ground terminals of the first connector;

a plurality of signal terminals that are arranged in each module housing; and at least one ground terminal supported in each module housing with at least a first contact section and a first spring arm section, with the first contact section having a first contact and a second contact both configured to engage a corresponding ground terminal of the first connector prior to reach a final mated position, wherein the first and second contacts are mechanically coupled and wherein one of the first and second contacts is not in contact with the corresponding ground terminal in the first connector when the second connector is in the final mated position.

2. The connector system as claimed in claim 1, further comprising:

a first guide element provided on the second connector for mating interaction with a complementary mating aperture on the first connector, wherein the first guide element is arranged on an upper face of the connector assembly.

3. The connector assembly as claimed in claim 2, wherein the first guide element is attached to the main housing.

4. The connector assembly as claimed in claim 2, further comprising:

a second guide element provided on the second connector for mating interaction with a complementary mating aperture of the first connector, wherein the second guide element is arranged on a lower face of the second connector, opposite the upper face.

5. The connector assembly as claimed in claim 4, wherein the module housings each have a receptacle for detachable attachment of the second guide element, and wherein the second guide element is attachable to the second connector at various positions.

6. The connector assembly as claimed in claim 4, wherein the second guide element comprises at least two separate guide elements.

7. The connector assembly as claimed in claim 1, wherein the connector modules form a stack, and wherein the main housing is essentially L-shaped, and covers an upper face and a rear face of the stack.

8. The connector assembly as claimed in claim 1, wherein the first and second contacts are arranged on the first spring arm section.

9. The connector as claimed in claim 1, wherein the first and second contacts are arranged colinearly or transversely offset.

10. The connector as claimed in claim 1, wherein the at least one ground terminal is stamped and formed, and the first and second contact each comprise a stamped projection.

11. The connector as claimed in claim 1, wherein the first contact section comprises a third contact.

12. The connector as claimed in claim 11, wherein the first spring arm section has a first leg and a second leg and has a recess between the first and the second legs.

13. The connector as claimed in claim 12, further comprising:

a front head section on which the first and second legs are connected to one another, and the first contact is arranged on the head section, the second contact is arranged on the first leg, and the third contact is arranged on the second leg.

14. The connector as claimed in claim 13, wherein at least two of the first, second and third contacts are longitudinally offset.

15. The connector as claimed in claim 1, wherein the first spring arm section has a connecting section and a spring section with the spring section being inclined with respect to the connecting section.

16. The connector as claimed in claim 1, wherein the signal terminals are arranged in a first plane, with one surface of the ground terminal faces the first plane, the ground terminal being resilient in a traverse direction with respect to the first plane, and a head section is curved in the direction of resiliency.

17. The connector as claimed in claim 1, wherein the ground terminal has a second spring arm section, a second contact section and a shield, with the shield being arranged between the first and second spring arm section.

18. The connector as claimed in claim 1, wherein the signal terminals are arranged in pairs, and the distance of the signal terminals within each pair is less than or equal to the distance between signal terminals of adjacent pairs.

19. A connector assembly, comprising:

a first connector with a first set of terminals arranged in columns and rows, the first set of terminals having a planar surface and configured to be mounted on a circuit board; and a second connector supporting a second set of terminals and mated to the first connector, the second set of terminals each having a first contact point and a second contact point both configured to engage the planar surface of the corresponding terminal from the first set of terminals when being mated together, wherein the first contact point is mechanically coupled to the second contact point such that the first contact point engaging the planar surface causes the second contact point to be suspended in space above the planar surface.

20. The connector assembly of claim 19, wherein the second set of terminals each have a distal end and wherein the first contact point is a first distance to the distal end and the second contact point is a second distance to the distal end, the second distance being less than the first distance.

* * * * *